United States Patent [19]

Kamiya

[11] Patent Number: 5,025,737

[45] Date of Patent: Jun. 25, 1991

[54] AUTOMATIC BOBBIN THREAD GUIDING APPARATUS

[75] Inventor: Osamu Kamiya, Chiryu, Japan

[73] Assignee: Brother Kogyo Kabushiki Kaisha, Japan

[21] Appl. No.: 403,442

[22] Filed: Sep. 6, 1989

[30] Foreign Application Priority Data

Sep. 12, 1988 [JP] Japan ..... 63-227975

[51] Int. Cl.[5] ..... D05B 65/02; D05B 57/14

[52] U.S. Cl. ..... 112/296; 112/184; 112/298

[58] Field of Search ..... 112/184, 229, 231, 253, 112/296, 298, 302

[56] References Cited

U.S. PATENT DOCUMENTS 1,816,308 7/1931 Allen ..... 112/296
3,760,749 9/1973 Trageser ..... 112/296
3,894,499 7/1975 Hamlett .

FOREIGN PATENT DOCUMENTS 55-11103 of 1980 Japan .
55-58173 of 1980 Japan .

*Primary Examiner*—Werner H. Schroeder
*Assistant Examiner*—Paul C. Lewis
*Attorney, Agent, or Firm*—Oliff & Berridge

[57] ABSTRACT

An automatic bobbin thread guiding apparatus in combination with a sewing machine has a work supporting bed, a throat plate, a shuttle race slide and a horizontally rotating shuttle. A bobbin thread holding assembly is provided between the shuttle race slide and the rotating shuttle, for clamping and carrying the bobbin thread end, and is operatively connected with the slide. A bobbin thread engagement guiding mechanism is provided for guiding the bobbin thread catching portion of the assembly so as to make the bobbin thread engage automatically with the bobbin thread tension adjusting mechanism in the rotating shuttle when the assembly is driven backward, and then to hold the catching portion at a given position for making the bobbin thread intersect with the needle thread loop when the assembly reached its rear end position.

8 Claims, 8 Drawing Sheets

AUTOMATIC BOBBIN THREAD GUIDING APPARATUS

BACKGROUND OF THE INVENTION

The present invention relates to an automatic bobbin thread guiding apparatus for a sewing machine, more particularly to such an apparatus for making the bobbin thread engage automatically with the bobbin thread tension adjusting mechanism in cooperation with manual shutting operation to shut the shuttle race slide from its opened position to its shut position.

Before starting of a sewing operation with a mechanical or electronically controlled sewing machine, after selecting desired needle thread and bobbin thread, an operator has to set the needle thread along the needle thread passage extending from the needle thread spool to the eye of the needle, and also has to set the bobbin in the bobbin case of the rotating shuttle and then has to make the bobbin thread engage with the needle thread at the eye of the needle after guiding the bobbin thread through the bobbin thread tension adjusting spring mechanism.

Many recent sewing machines are provided with a horizontally rotating shuttle because of simplified bobbin cases. In these sewing machines, as preparatory work, the operator has to draw out the bobbin thread through a guide slit of the bobbin case and then make the bobbin thread engage with the bobbin thread tension adjusting spring mechanism. After that, the operator has to reciprocate the needle vertically by one cycle with manual driving and then draw out the bobbin thread intersected with the needle thread end through the needle hole of the throat plate. The operator has to do this preparatory work manually. Meanwhile, various automatic needle thread engaging mechanisms for simplifying the engaging operation of the needle thread have been proposed, but the present inventor does not know of any automatic bobbin thread engaging mechanism for simplifying the engaging operation of the bobbin thread. In a sewing machine including a horizontally rotating shuttle, it seems impossible to install a bobbin thread engaging mechanism in the very narrow space between the bobbin case and the throat plate.

Additionally, Japanese Utility Model Publication (not examined) No. 55-11103 discloses a mechanical structure of a bobbin case in a horizontally rotating shuttle that can decrease noises caused in a sewing operation and wear of the bobbin case. On the other hand, Japanese Utility Model Publication (not examined) No. 55-58173 discloses a mechanical structure of a horizontally rotating shuttle that makes the bobbin thread disengage from the thread engaging portion of the adjusting plate and engage automatically with the engaging portion during a sewing operation, by means of a spring member for preventing the bobbin thread from disengaging between the adjusting plate and the tension adjusting spring of the bobbin thread tension adjusting spring mechanism.

However, these mechanisms are useless for simplifying and automating an engaging operation of the bobbin thread. As described above, in order to prepare the bobbin thread, while clamping the bobbin thread end with fingers, the operator has to introduce the bobbin thread into the guide slit and then move the bobbin thread end leftward slightly to make the bobbin thread engage with the bobbin thread tension adjusting spring mechanism. At the same time, the operator has to check whether the thread is engaging surely or not. Therefore, these engaging operations of the bobbin thread are rather complicated and troublesome for the operator. Furthermore, these engaging operations are necessary for every exchanging of the bobbin, so the operations are very difficult for unskilled operators.

SUMMARY OF THE INVENTION

The first object of the present invention is to present an apparatus for making the bobbin thread engage automatically with the bobbin thread tension adjusting spring mechanism, in cooperation with the shutting movement of the shuttle race slide, when exchanging the bobbin including bobbin thread.

The second object of the invention is to present an apparatus for holding the bobbin thread end at a given position for intersecting the bobbin thread with the needle thread loop when starting a stitching operation.

An automatic bobbin thread guiding apparatus according to the present invention is in combination with a sewing machine comprising a work supporting bed, a throat plate, a shuttle race slide and a horizontally rotating shuttle.

This automatic bobbin thread guiding apparatus is characterized by comprising: a bobbin thread holding assembly disposed between the shuttle race slide and the horizontally rotating shuttle, and comprising a bobbin thread catching portion for clamping an end of the bobbin thread, and connected operatively with a rear end portion of the shuttle race slide so as to be driven forward and backward by the shuttle race slide; a bobbin thread engagement guiding mechanism for guiding the bobbin thread holding assembly so that, when the shuttle race slide is driven from its opened position to its shut position, the bobbin thread catching portion moves from a predetermined upper front near position relative to the bobbin thread tension adjusting spring mechanism in a direction along the bobbin thread tension adjusting spring mechanism and then moves to a predetermined position outward of an outer circumference of the bobbin case.

DESCRIPTION OF THE PREFERRED EMBODIMENTS

A preferred embodiment of the present invention will be described hereinafter with reference to the accompanying drawings. The present embodiment is a case where the present invention is applied to an electronically controlled sewing machine provided with a horizontally rotating shuttle.

An arm of the sewing machine, is provided with therein a needle bar vertically driving mechanism 0 for vertical motion of a needle bar 2, a needle bar swing mechanism for laterally jogging motion of the needle bar 2, and a take-up lever driving mechanism. A work supporting bed 4 is provided with a vertical feed driving mechanism therein for vertical motion of a feed dog for feeding a work fabric, and a horizontal feed driving mechanism for forward/backward horizontal motion of the feed dog. The needle bar 2 is driven laterally with a known swing control motor through the needle bar swing mechanism, and the feed dog is driven with a known feed control motor through the horizontal feed mechanism. The needle bar vertically driving mechanism, the vertical feed driving mechanism and the take-up lever driving mechanism are driven with a known main motor.

Figure 2:
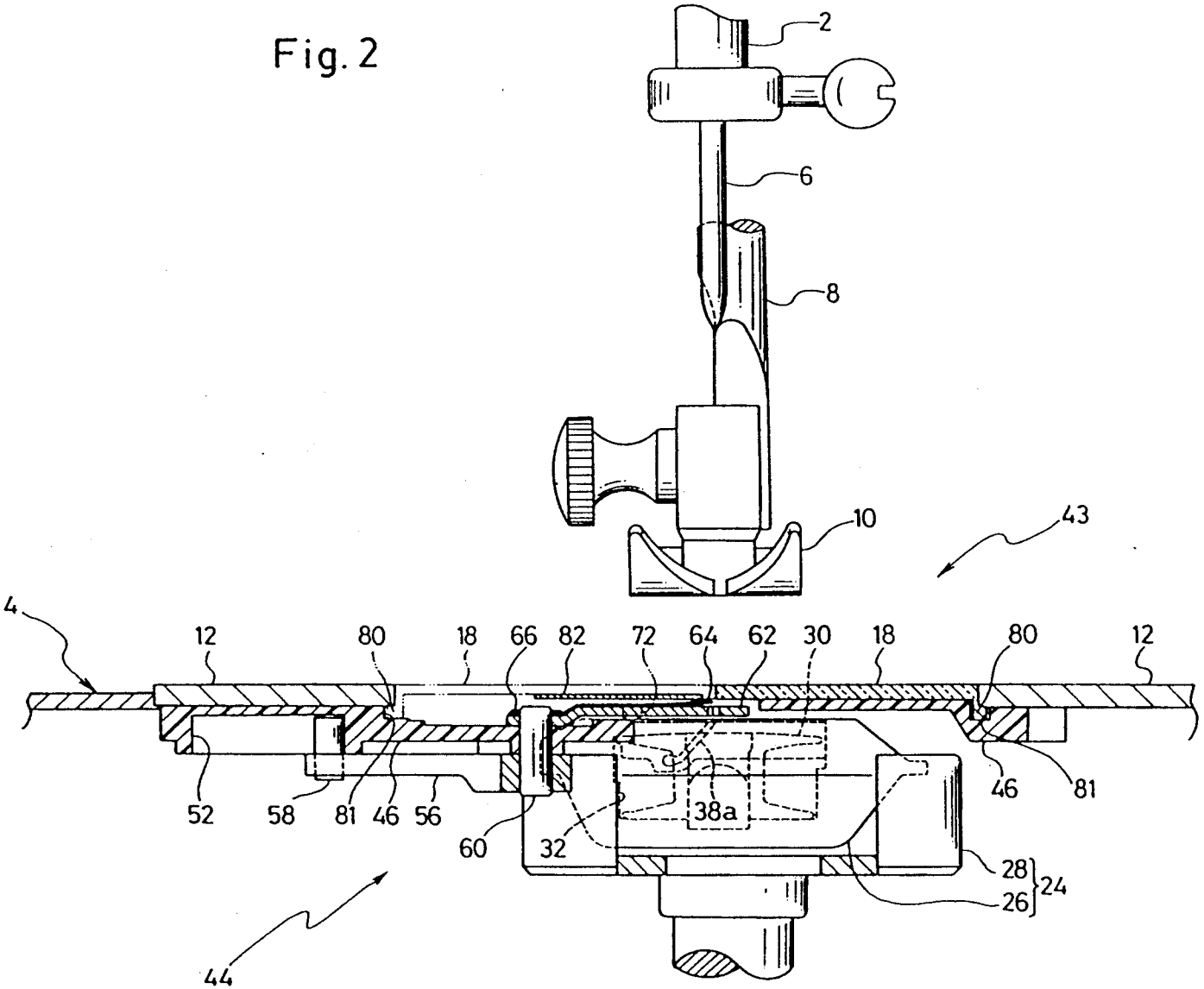
FIG. 2 is a sectional view taken on line II-II in FIG. 1.

Referring now to FIG. 2, a needle 6 is attached on the lower end of the needle bar 2, and a presser foot 10 is attached detachably on the lower end of the presser bar 8 behind the needle bar 2.

Referring now to FIGS. 1,2,6 and 7, a throat plate 12 is fixed with screw 14 on the upper surface of the work supporting bed 4 below the head portion of the arm. This throat plate 12 is provided with an opening 16 and a shuttle race slide 18 made of transparent synthetic resin material, and the shuttle race slide 18 for covering the opening 16 is attached slidably in the opening 16. A pair of guide portions 80 is formed on the right and left end portions of the race slide 18, and these guide portions 80 are engaged slidably forward and backward with a pair of guide grooves 81 formed horizontally in the direction forward and backward on a bobbin case presser plate 46 which is disposed on the under surface of the throat plate 12. Additionally, numeral 20 designates slits formed on the throat plate 12 for facilitating vertical motion of the feed dog, and numeral 22 designates a hole for the needle.

Under the middle portion of the shuttle race slide 18 in its shut position, the horizontally rotating shuttle 24 is installed in the work supporting bed 4, and this horizontally rotating shuttle 24 comprises a bobbin case 26 and rotating looptaker 28 driven rotatively by the main motor and for containing the bobbin case 26. The bobbin case 26 has a bobbin hole 32 for containing a bobbin including bobbin thread 34 and a bobbin thread tension adjusting spring mechanism 36 for exerting a tension on the bobbin thread 34. This adjusting spring mechanism 36 is installed at the upper part of the front portion of the circumferential wall of the bobbin chamber 32 of the bobbin case 26. Additionally, numeral 29 designates a looptaker for catching the needle thread.

Figure 4:
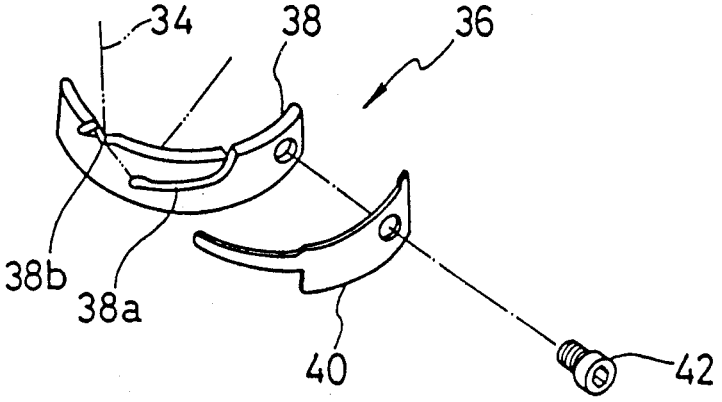
FIG. 4 is a disassembled perspective view of the bobbin thread tension adjusting spring mechanism.

Referring now to FIG. 4, the tension adjusting spring mechanism 36 comprises an adjusting plate 38 curved like an arc in plain view and an adjusting plate spring 40 fixed on the outer surface of the adjusting plate 38 with a screw 42. The adjusting plate 38 is provided with a guide slit **38*a* for guiding the bobbin thread 34 and a notch 38*b* for engaging the bobbin thread 34. The bobbin thread 34 supplied from the bobbin case 30 passes through the guide slit 38*a* from inside to outside, then passes between the adjusting plate 38 and the plate spring 40, and then passes through the notch 38*b*. Thereby a tension is exerted on the bobbin thread 34 by resilient force of the plate spring 40**.

Hereinafter, description will be made of a bobbin thread guiding mechanism 43 for guiding the bobbin thread 34 to engage automatically with the bobbin thread tension adjusting spring mechanism 36, with reference to FIG. 1, 2 and 3.

The bobbin thread guiding mechanism 43 comprises a thread holding assembly 68, a bobbin thread engagement guiding mechanism 44, and a knife member 82. The thread holding assembly 68 comprises a holding member 62 and a holding plate spring 64 which have a thread catching portion 70 for catching the end of the bobbin thread 34. The bobbin thread engagement guiding mechanism 44 comprises a first cam groove 52 and a second cam groove 54 for engaging the bobbin thread 34 with the bobbin thread tension adjusting spring mechanism 36, and a thread engagement guide member 56 and a third cam groove 78 formed at the left-side rear end portion on the under surface of the shuttle race slide 18.

The bobbin case presser plate 46 is installed under the opening 16 and both its side portions of the throat plate 12, the presser plate 46 is fixed to the under surface of the throat plate 12 with four screws 48. A bobbin passage opening 50 for passing the bobbin 30 is formed in the middle portion of the presser plate 46, and the first cam groove 52 opening downward is formed at the left end portion on the under surface of the presser plate 46, and the second cam groove 54 is formed through the presser plate portion near the left end of the bobbin passage opening 50. The upper portion of a pin 58 is engaged in the first cam groove 52, and the lower portion of the pin 58 is fixed to the left end of the thread engagement guide member 56. The lower end of a pin 60 passing through the second cam groove 54 is fixed to the right end of the guide member 56, and the upper end of the pin 60 is inserted into and fixed to the left ends of the holding member 62 and the holding plate spring 64 and a washer 66 which are stacked without gap. The holding member 62 has a V-shaped notch **62*a* opened at its large rear end and a slit 62*b* extending from the bottom end of the notch 62*a*** towards the left.

The right end portion of the holding plate spring 64 is formed triangularly so as not to cover the V-shaped notch **62*a* and so as to guide the bobbin thread 34 into the slit 62*b* through the notch 62*a*. Additionally, the angle between the thread engagement guide member 56 and the holding member 62** is about 140 degrees.

Figure 3:
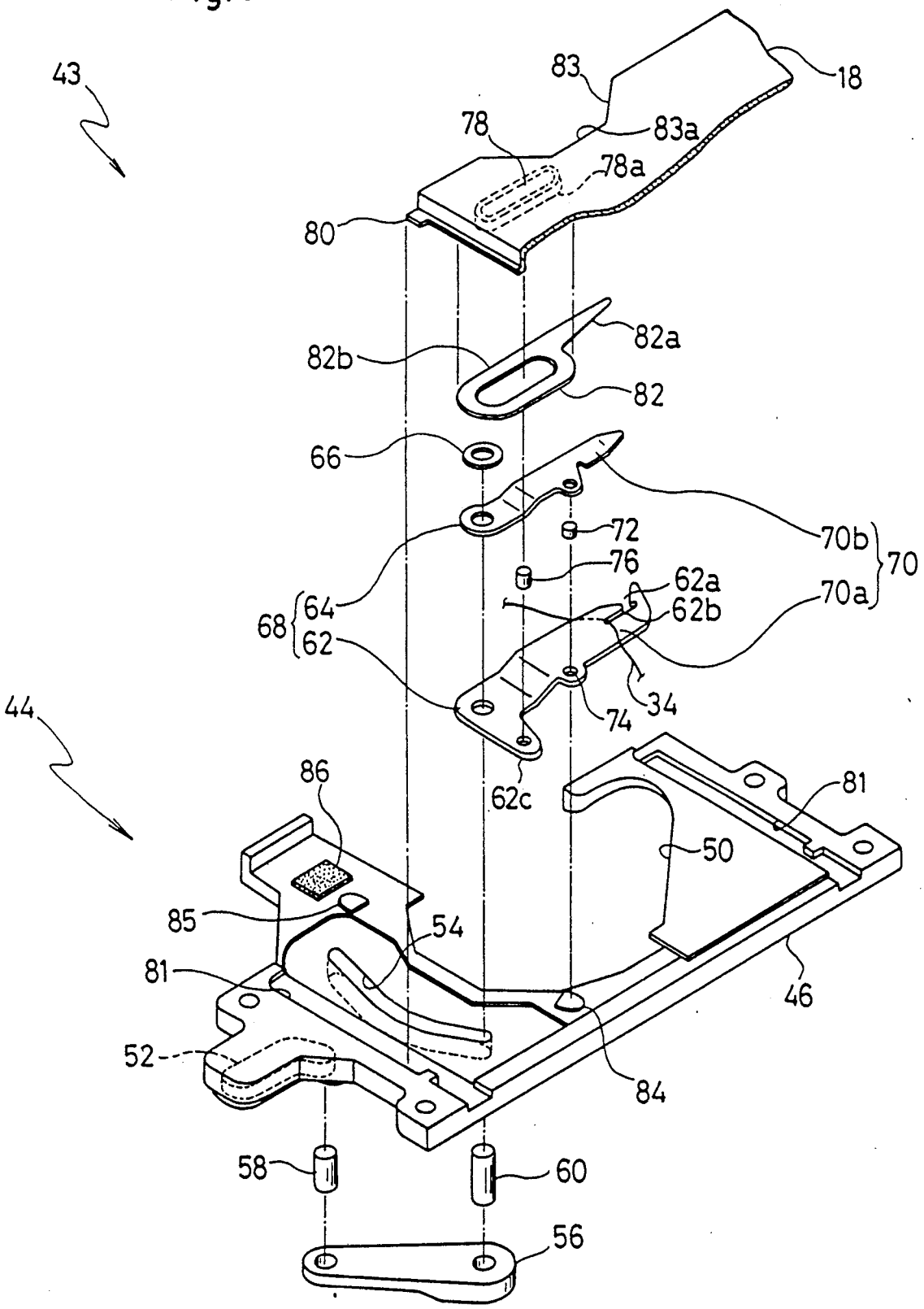
FIG. 3 is a disassembled perspective view of the bobbin thread guiding mechanism.
Figure 5:
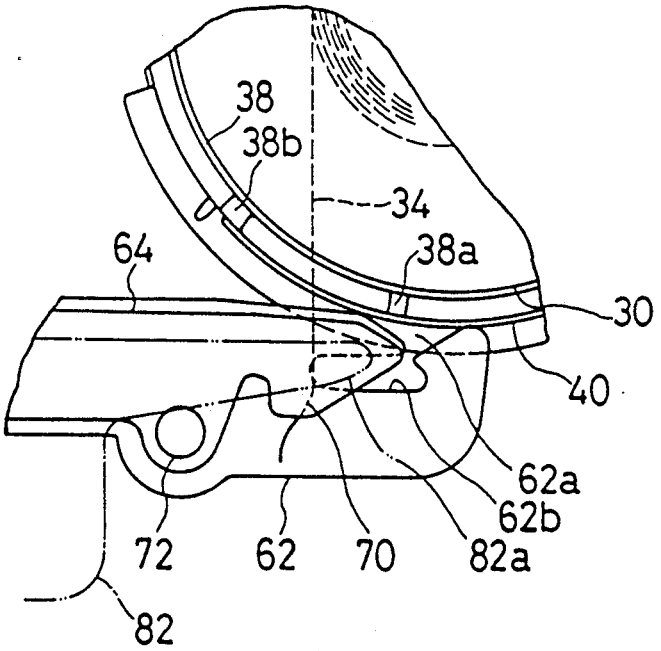
FIG. 5 is an enlarged partial plan view of the horizontally rotating shuttle and the thread holding assembly.

As shown in FIG. 3 and FIG. 5, the holding plate spring 64 is disposed on and in contact with the holding member 62, and when the bobbin thread 34 is introduced into the slit **62*b* through the notch 62*a* and then is guided between the holding member 62 and the holding plate spring 64, the bobbin thread 34 is clamped between a supporting portion 70*a* of the holding member 62 and a pressing portion 70*b* of the holding plate spring 64. Thus, the bobbin thread 34 is caught resiliently with elastic force of the holding plate spring 64. That is, the supporting portion 70*a* and the pressing portion 70*b* constitute the thread catching portion 70. The supporting portion 70*a* is formed at the front side near the left end of the slit 62*b*, and the V-shaped notch 62*a* is positioned at an upper front rightward near position relative to the upper end of the guide slit 38***a* in plan view.

The top end of a clamp release pin 72 is fixed to the middle of the holding plate spring 64, and this clamp release pin 72 is inserted through a pin hole 74 of the holding member 62, and its hemi-spheric lower end extends from the under surface of the holding member 62.

The lower end of a drive pin 76 is engaged into a pin hole on the expanded portion 62*c* of the holding member 62 and fixed thereto, and the upper end of the drive pin 76 is engaged into the third cam groove 78 formed laterally on the under surface of the rear left end portion of the shuttle race slide 18.

This third cam groove 78 opened downward is formed inside of a long circular rib 78*a* on the under surface of the shuttle race slide 18.

The knife member 82 is attached on the under surface of the shuttle race slide 18 by engaging the long ring portion 82*b* of the knife member 82 with the rib 78*a*. The cutting edge 82*a* of the knife member 82 is extending partially from a trapezoidal cutout 83 formed at the rear end left portion of the shuttle race slide 18, and the cutting edge 82*a* intersects a sharp edge 83*a* of the bottom end of the cutout 83 at an acute angle. When the shuttle race slide 18 is at its opened position, the right end of the cutting edge 82*a* is positioned slightly leftward of the right end of the holding plate spring 64. Thus, an operator can cut the bobbin thread 34 with the cutting edge 82*a* by introducing the thread 34 between the cutting edge 82*a* and the sharp edge 83*a* and then pulling the thread 34 leftward.

Figure 1:
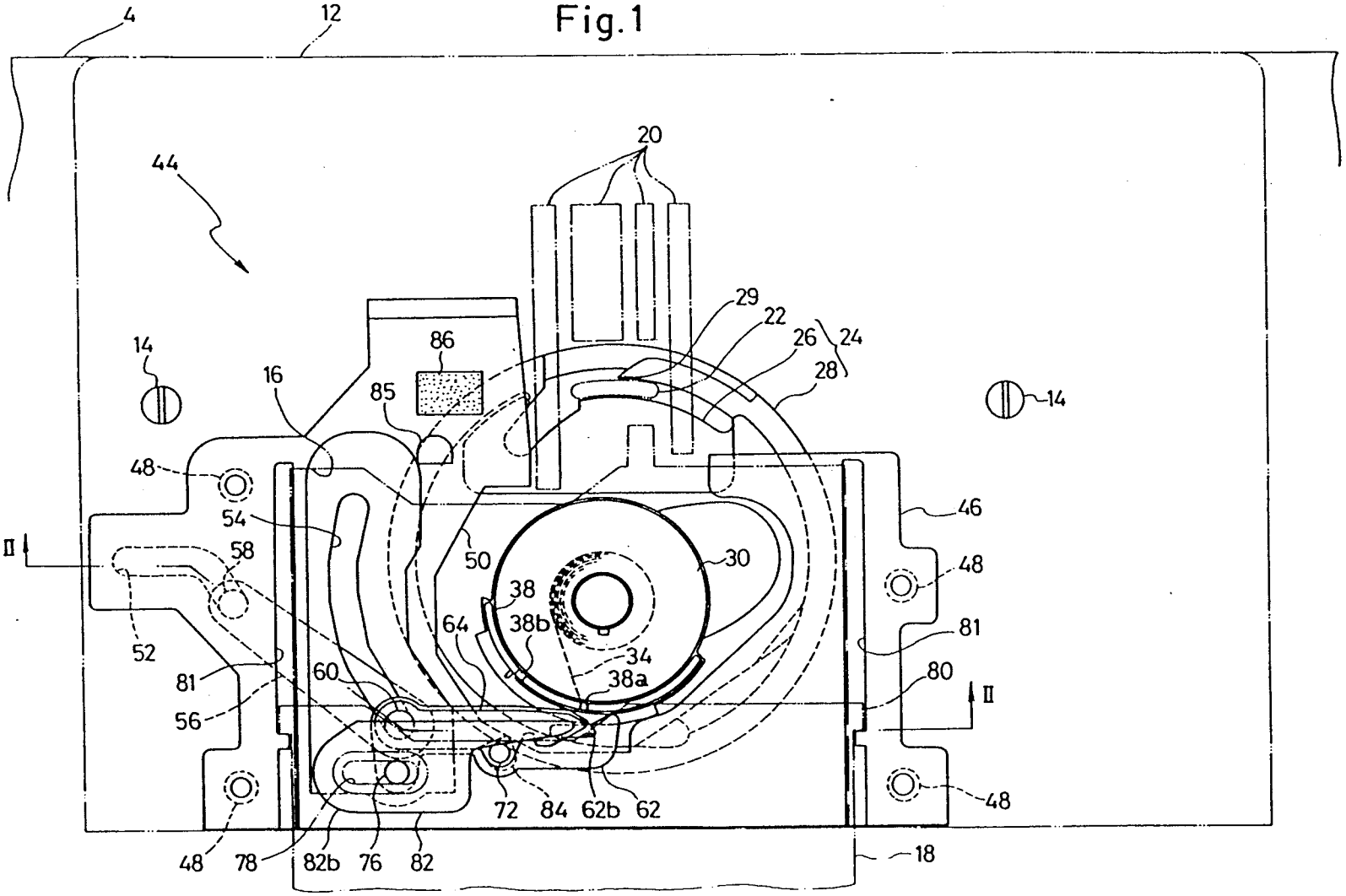
FIG. 1 is a plan view of a bobbin thread guiding mechanism installed in the work supporting bed of a sewing machine exemplifying a preferred embodiment of the present invention.
Figure 6:
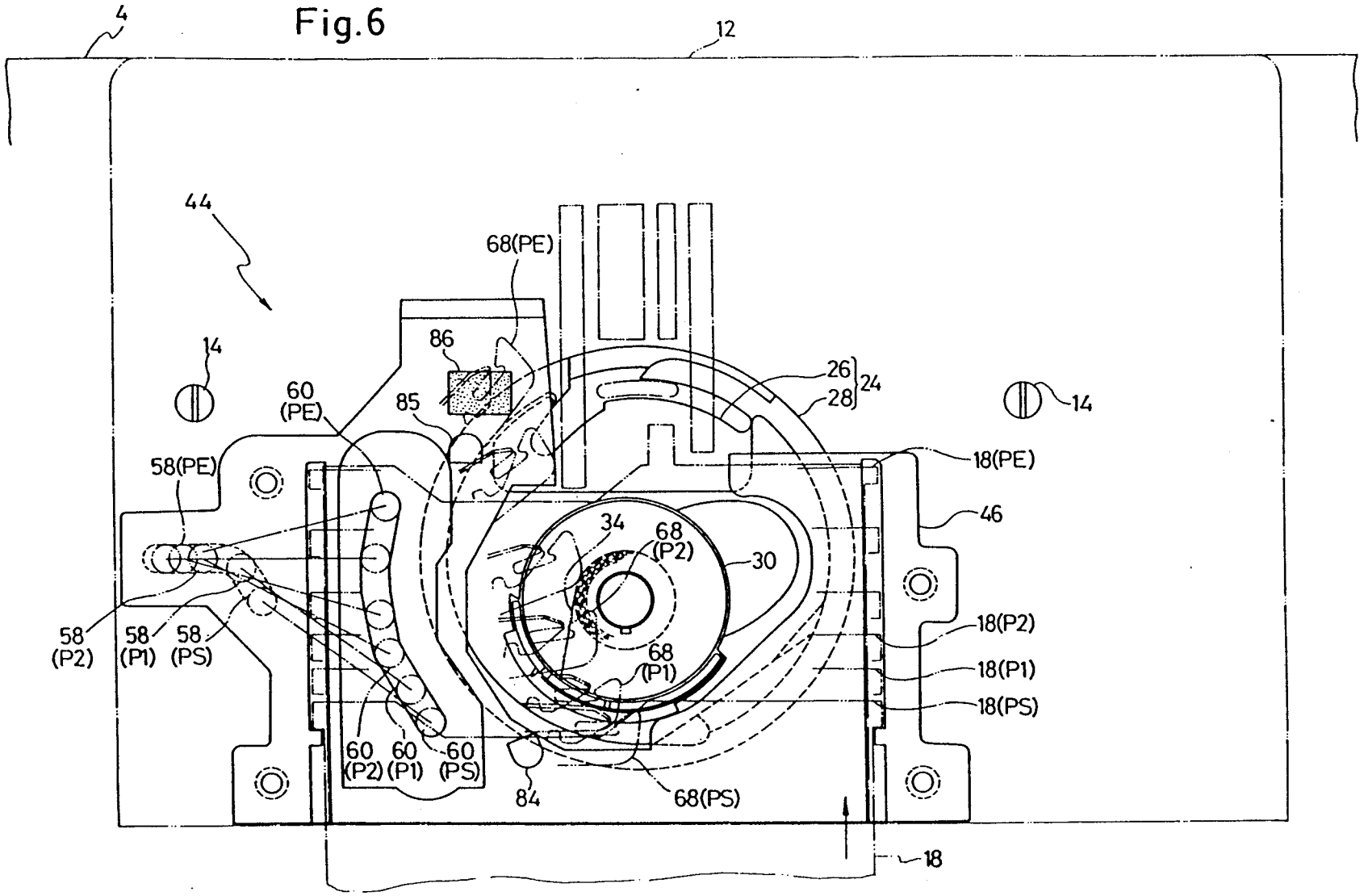
FIG. 6 is a plan view equivalent to FIG. 1 for showing movement of the shuttle race slide.
Figure 7:
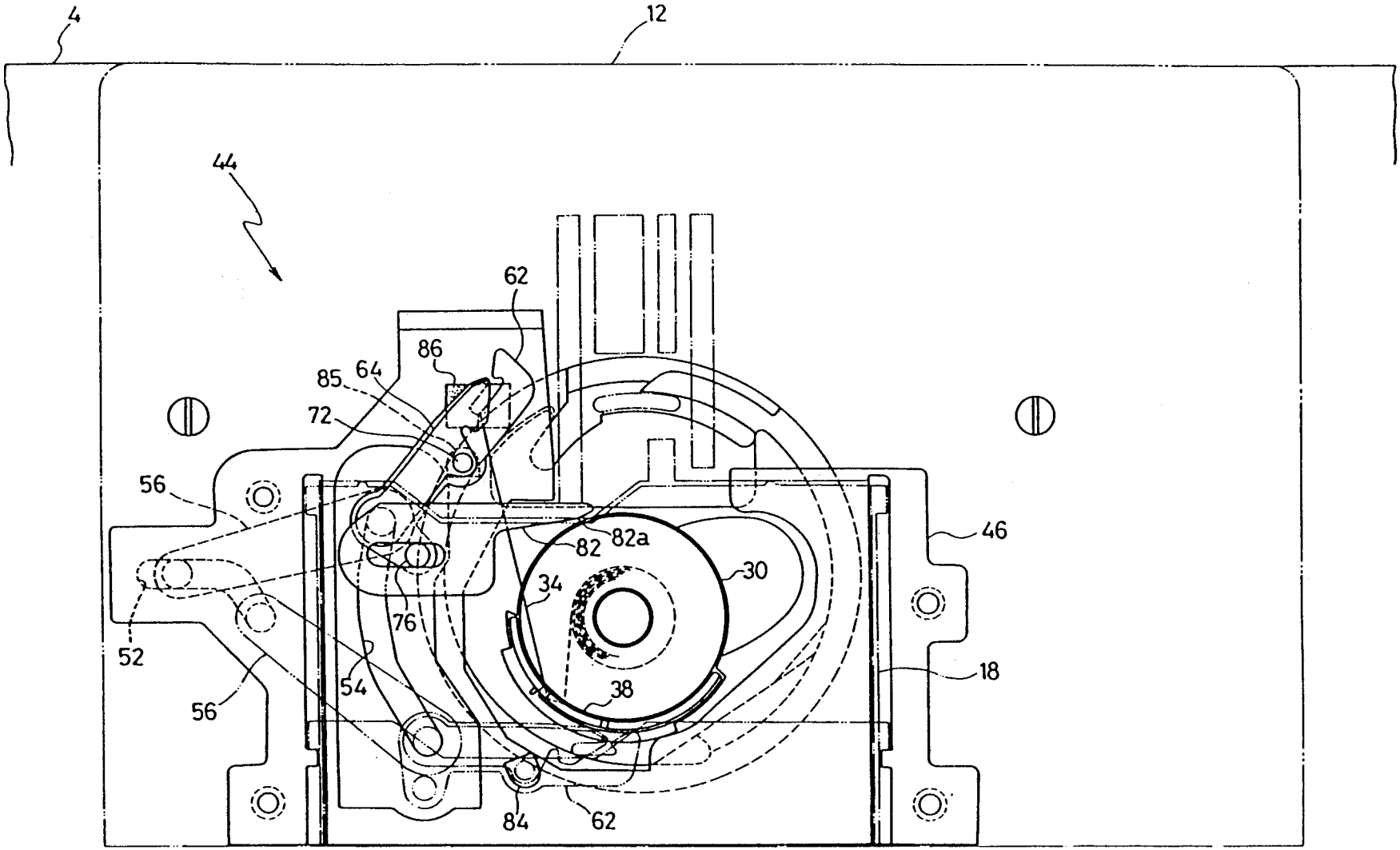
FIG. 7 is a plan equivalent to FIG. 1 for showing the shuttle race slide in its shut position.

The shuttle race slide 18 is movable between the opened position shown in FIG. 1 and the shut position shown in FIG. 6, and the thread holding assembly 68 is movable forward and backward together with the shuttle race slide 18. On the upper surface of the presser plate 46, there are provided a pair of small islands 84, 85 are each corresponding to the clamp release pin 72 of the shuttle race slide 18 at its opened position and its shut position. When the lower end of the clamp release pin 72 is pushed upward by the island 84 or 85, the holding plate spring 64 is moved upward, and thus a small gap is generated between the holding member 62 and the holding plate spring 64, and this gap facilitates release of the bobbin thread 34 from the thread catching portion 70. On the rear end portion of the presser plate 46, a thin sponge plate 86 is pasted near the island 85, and the bobbin thread 34 is clamped elastically between this sponge plate 86 and the holding member 62, when the bobbin thread 34 is released from the thread catching portion 70 by pushing the pin 72 with the island 85.

Hereinafter, description will be made of function to engage the bobbin thread 34 with the bobbin thread tension adjusting spring mechanism 36 by the bobbin thread guiding mechanism 43.

As shown in FIG. 1, after moving the shuttle race slide 18 to its opened position and after clamping the end of the bobbin thread 34 with fingers, the bobbin 30 is set in the bobbin hole 32 of the bobbin case 26 so that the bobbin thread 34 can be drawn out in the counterclockwise direction. Since the shuttle race slide 18 is at its opened position, the clamp release pin 72 is pushed upward by the island 84 to generate a small gap between the holding member 62 and the holding plate spring 64, and the V-shaped notch 62*a* is positioned at an upper rightward front position against the upper end of the guide slit 38*a*. Then, the bobbin thread end clamped by the fingers is moved in the front direction and the bobbin thread 34 is introduced into the slit 62*b* through the V-shaped notch 62*a*. After that, by moving the bobbin thread end leftward, as shown in FIG. 5, the bobbin thread 34 drawn out of the bobbin 30 is introduced into the guide slit 38*a* through its upper opening, and when the bobbin thread 34 has reached the thread catching portion 70 through the guide slit 38*a*, slit 62*b* and the gap between the holding member 62 and the holding plate spring 64, the bobbin thread 34 is cut off with the cutting edge 82*a* and the sharp edge 83*a*. Accordingly, in this state, the bobbin thread 34 supplied from the bobbin 30 is passing through the middle part of the guide slit 38*a*, the gap between the adjusting plate 38 and the adjusting plate spring 40 and the slit 62*b*. Also, the end of the bobbin thread 34 is clamped slightly with the thread catching portion 70, while being held with the edges 82*a*, 83*a*.

As shown in FIG. 6, when the shuttle race slide 18 is moved sequentially from its opened position 18(PS) via the first position 18(P1), the second position 18(P2) . . . to the shut position 18(PE), the drive pin 76 engaging with the third cam groove 78 is moved backward, and therefore the holding assembly 68 moves backward. At the same time, as the pin 60 engaging with the second cam groove 54 moves sequentially from its movement start position 60(PS) via the first position 60(P1), the second position 60(P2) . . . to the movement end position 60(PE), the pin 58 engaging with the first cam groove 52 moves sequentially through the thread engagement guide member 56 from the movement start position 58(PS) via the first position 58(P1), the second position 58(P2) . . . to the movement end position 58(PE). Therefore, the thread holding assembly 68 moves backward while swaying sequentially, through backward movement of the pin 60 and sway movement of the thread engagement guide member 56, from the movement start position 68(PS) via the first position 68(P1), the second position 68(P2) . . . to the movement end position 68(PE). Accordingly, the movement locus of the thread catching position 70 is like a curved line along the shape of the adjusting plate 38 from the movement start position 68(PS) of the thread holding assembly 68 to the second position 68(P2), and after that the movement locus is like a straight line to the movement end position 68(PE). The thread catching portion 70 corresponding to the movement end position 68(PE) is positioned at the middle of the sponge plate 86 positioned at a predetermined position outward of the outer circumference of the bobbin case 26.

When the shuttle race slide 18 is moved slightly from its opened position 18(PS) to the first position 18(P1), the lower end of the clamp release pin 72 disengages from the island 84, and the holding plate spring 64 returns to its original position, and therefore the end portion of the bobbin thread 34 can be clamped elastically with the thread catching portion 70.

Furthermore, when the shuttle race slide 18 moves from its opened position 18(PS) to the second position 18(P2), the end portion of the bobbin thread 34 moves in the clamped condition with the thread catching portion 70, and therefore the bobbin thread 34 is moved to the bottom end of the guide slit 38*a* while being drawn out from the bobbin 30 as shown in FIG. 6 and then engages with the notch 38*b*. As described hereinafter, the bobbin thread 34 is forced to engage with the bobbin thread tension adjusting spring mechanism 36 with certainty, and a preferrable tension is exerted on the bobbin thread 34.

And after that, as shown in FIG. 6, when the shuttle race slide 18 moves to its shut position 18(PE) together with the thread holding assembly 68, the thread catching portion 70 moves to a position corresponding to the middle of the sponge plate 86. Then, the clamp release pin 72 is pushed upward with the island 85 to generate a gap between the holding member 62 and the holding plate spring 64, and therefore the end portion of the bobbin thread 34 is released from the thread catching portion 70. But, in this condition, the bobbin thread portion positioned under the lower surface of the holding member 62 is clamped elastically by the sponge plate 86.

In the above condition, when the start/stop switch is operated to start a stitching operation, the needle 6 with needle thread descends through the hole 22 of the throat plate 12, and a needle thread is caught by the looptaker 29 of the rotating looptaker 28 to form the needle thread loop, and then when this needle thread loop rotates around the bobbin case 26 with the rotating looptaker 28, the needle thread intersects surely with the bobbin thread portion between the thread catching portion 70 and the notch 38*b*, and therefore normal stitching can be started from the first stitching stroke. Additionally, when the thread holding member 62 moves to the movement end position 68(PE), a necessary amount of the bobbin thread 34 for the first stitching stroke is drawn out from the bobbin 30 by the thread catching portion 70.

Meanwhile, descriptions will be made of a modified embodiment of the bobbin thread engagement guiding mechanism 44 wherein the presser plate 46 is omitted. The same members as those of above-described bobbin thread engagement guiding mechanism 44 are designated with same numerals, respectively.

Figure 8:
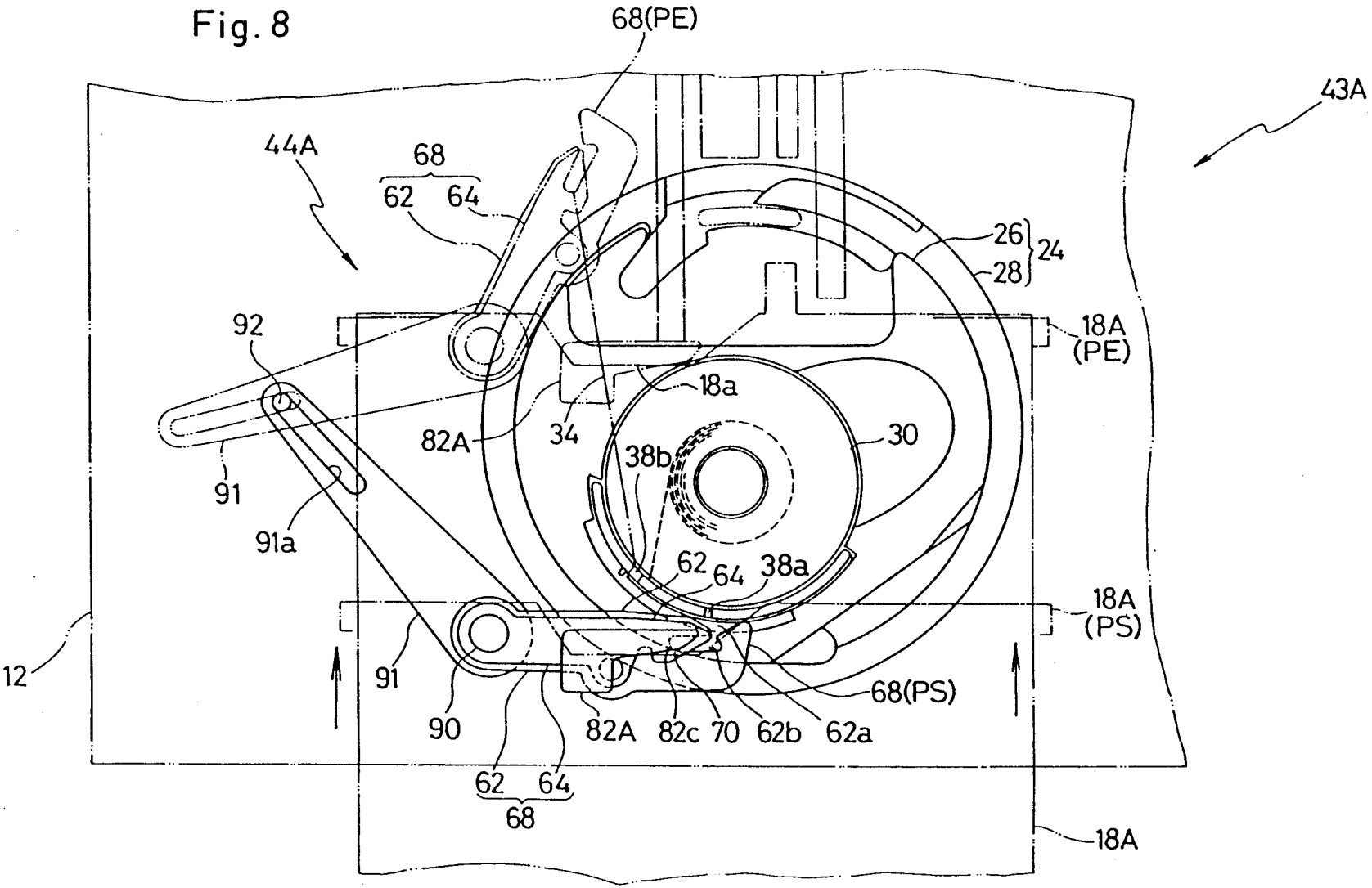
FIG. 8 is a plan view of a first modified bobbin thread guiding mechanism and a work supporting bed.

As shown in FIG. 8, a pin 90 is pivoted at its upper end portion on the rear left end portion of the shuttle race slide 18A, and this pin 90 extending below is penetrating and fixed to the left end portion of the holding plate spring 64, the left end portion of the holding member 62 and the right end portion of a sway arm 91 which elements are stacked without a gap. An angle between the thread holding assembly 68 and the sway arm 91 is about 130 degree in plain view.

The sway arm 91 is provided with a long pin hole 91*a* like a slit formed on the left half portion thereof, and this pin hole 91*a* is penetrated movably by a pin 92 fixed to the under surface of the throat plate 12 at its upper end. When the shuttle race slide 18A is at its opened position, the V-shaped notch 62*a* is positioned at the upper front rightward position relative to the upper end of the guide slit 38*a*, and the thread catching portion 70 is positioned at the upper front position relative to the upper end of the guide slit 38*a*. A knife member 82A is installed on the under surface of the rear end portion of the shuttle race slide 18A, and the cutting edge 82*c* of the knife member 82A intersects with the sharp edge 18*a* of the shuttle race slide 18A.

Next, descriptions will be made of the engaging function of making the bobbin thread engage with the bobbin thread tension adjusting spring mechanism 36 by the bobbin thread engagement guiding mechanism 44A.

First, as in the above-described embodiment, after moving the shuttle race slide 18A to its opened position 18A(PS), in the condition of clamping the bobbin thread end with fingers, the bobbin 30 is set in the bobbin hole 32 so that the bobbin thread 34 is drawn out from the bobbin 30 in the counterclockwise direction. Then, the bobbin thread end clamped with fingers is moved forward to introduce the bobbin thread 34 into the slit 62*b* through the V-shaped notch 62*a*, and after that, while moving the bobbin thread 34 forward, the bobbin thread 34 drawn out from the bobbin 30 is introduced into the guide slit 38*a* through the upper opening thereof. And, when the bobbin thread 34 has reached the thread catching portion 70 via the guide slit 38*a*, the slit 62*b* and the gap between the holding member 62 and the holding plate spring 64, the bobbin thread 34 is cut off with the cutting edge 82*a*. Accordingly, in this condition, the bobbin thread 34 is extending from the bobbin 30 via the middle part of the guide slit 38*a*, the gap between the holding member 62 and the holding plate spring 64, and the slit 62*b*, and the bobbin thread end is clamped with the thread catching portion 70.

Thus, when the shuttle race slide 18A is moved from its opened position 18A(PS) to its shut position 18A(PE), the thread holding assembly 68 is moved from its movement start position 68(PS) to its movement end position 68(PE). Accordingly, through movement of the thread holding assembly 68, the bobbin thread 34 clamped by the thread catching portion 70 engages certainly with the bobbin thread tension adjusting spring mechanism 36, and then the thread catching portion 70 moves to a predetermined position outward of the circumference of the bobbin case 26.

In this condition, when the start/stop switch is operated to start a stitching operation, as the needle thread loop rotates around the bobbin case 26, the needle thread intersects certainly with the bobbin thread portion between the thread catching portion 70 and the notch 38*b*, and thus normal stitching is started from the first stitching stroke.

Figure 9:
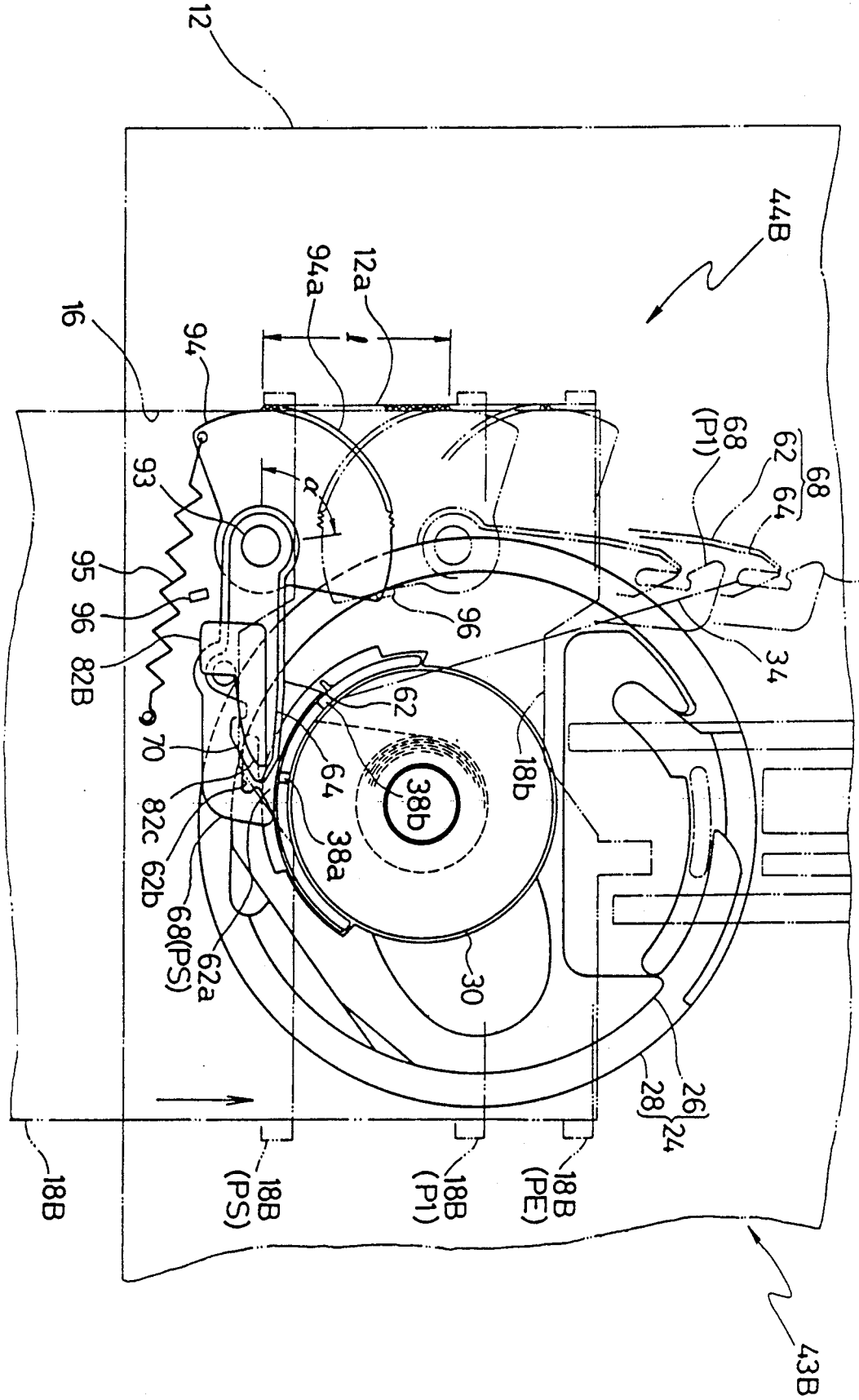
FIG. 9 is a plan view of the second modified bobbin thread guiding mechanism and the work supporting bed.

Furthermore, another modified bobbin thread engagement guiding mechanism 44B may be constituted as shown in FIG. 9 by modifying partially the above-described bobbin thread engagement guiding mechanism 44. The same members are designated with the same numerals, respectively.

A pin 93 is fixed to the under surface of the rear left portion of the shuttle race slide 18B, and this pin 93 extending below is penetrated and fixed to the left end portion of the holding plate spring 64, the left end portion of the holding member 62 and the central portion of a sector gear 94, in the condition of making them contact without gap. This sector gear 94 is provided with gears 94*a* on its outer circumference portion corresponding to a predetermined angle $\alpha$ (for example, $\alpha$ is equal to 82 degree), and this sector gear 94 is forced in the counterclockwise direction with a coil spring 95.

On the other hand, the throat plate 12 is provided with gears 12*a* engageable with gears 94*a* on the left edge portion of the opening 16.

When the shuttle race slide 18B is positioned at its opened position, the V-shaped notch 62*a* is positioned at the upper front rightward position relative to the upper opening of the guide slit 38*a*, the thread catching portion 70 is positioned at the upper front position relative to the upper opening of the guide slit 38*a*, and the left end of gears 94*a* engages with the front end of gears 12*a*.

A knife member 82B is attached on the under surface of the rear end part of the shutter race slide 18B, and its cutting edge 82*c* intersects with the sharp edge 18*b* of the slide 18B at an acute angle. On the under surface of the shuttle race slide 18B, there is installed a pin 96 for preventing the sector gear 94 from rotating in the counterclockwise direction with elastic force of the coil spring 95, when the right end of the gears 94*a* has disengaged from the rear end of the gears 12*a* in the course of backward movement of the race slide 18B.

Next, description will be made on function of the bobbin thread guiding mechanism 43B for making the bobbin thread 34 engage with the bobbin thread tension adjusting spring mechanism 36.

First, as same with the above-described embodiment, after moving the shuttle race slide 18B to its opened position 18B(PS), in the condition of clamping the bobbin thread end with fingers, the bobbin 30 is set in the bobbin hole 32 so that the bobbin thread 34 is drawn out from the bobbin 30 in the counterclockwise direction. Then, the bobbin thread end clamped with fingers is moved forward to introduce the bobbin thread 34 into the slit 62*b* through the V-shaped notch 62*a*, and after that, while moving the bobbin thread 34 forward, the bobbin thread 34 drawn out from the bobbin 30 is introduced into the guide slit 38*a* through the upper opening thereof. And, when the bobbin thread 34 has reached the thread catching portion 70 via the guide slit 38*a*, the slit 62*b* and the gap between the holding member 62 and the holding plate spring 64, the bobbin thread 34 is cut off with the cutting edge 82*a*. Accordingly, in this condition, the bobbin thread 34 is extending from the bobbin 30 via the middle part of the guide slit 38*a*, the gap between the holding member 62 and the holding plate spring 64, and the slit 62*b*, and the bobbin thread end is clamped with the thread catching portion 70.

Thus, when the shuttle race slide 18B is moved from its opened position 18B(PS) to the first position 18(P1), as the sector gear 94 rotates in the counterclockwise direction through engagement of gears 94*a* and gears 12*a*, the thread holding assembly 68 moves from its movement start position 68(PS) to the first position 68(P1) while swinging in the counterclockwise direction. In accordance with this movement, although the right end of the gears 94*a* disengages from the rear end of the gears 12*a*, the sector gear 94 is prevented from swinging in the counterclockwise direction by the stopper 96 receiving the left end surface of the sector gear 94. Prior to this condition, the bobbin thread 34 clamped with the thread catching portion 70 engages certainly with the bobbin thread tension adjusting spring mechanism 36 through backward movement of the thread holding assembly 68. Then, while the shuttle race slide 18B moving toward its shut position 18B(PE), the thread holding assembly 68 moves toward its movement end position 68(PE) in parallel with the assembly 68 in the first position 68(P1). When the thread holding assembly is positioned at its movement end position 68(PE), the thread catching portion 70 is positioned at a predetermined position outward of the outer circumference of the bobbin case 26.

In above condition, when the start/stop switch is operated to start a stitching operation, the needle thread loop being carried by the looptaker 29 intersects certainly with the bobbin thread portion between the thread catching portion 70 and the notch 38*b*, and thus normal a stitching operation can be started from the first stitching stroke.

As described hereinbefore, when the shuttle race slide 18, 18A, 18B moves from its opened position to its shut position, as the thread catching portion 70 clamping the bobbin thread end is carried by the thread holding assembly 68 which is driven by the shuttle race slide 18, 18A, 18B, the bobbin thread 34 is made to engage certainly with the bobbin thread tension adjusting spring mechanism 36, and finally the thread catching portion 70 holds the bobbin thread end at a given position outward of the outer circumference of the bobbin case 26.

In the above condition, when a stitching operation is started, the needle thread intersects certainly with the bobbin thread 34, and therefore a normal stitching operation can be started from the first stitching stroke. Thus, according to the present invention, it is possible to automate the bobbin thread engaging operation with a simple mechanism, and to make the bobbin thread engaging operation easy and speedy.

Additionally, as a modified thread holding assembly 68, this assembly 68 can be constituted with only the holding member 62, and a minute narrow slit portion for clamping the bobbin thread end is formed at the end part of the slit 62*b* instead of the thread catching portion 70.

What is claimed is:

1. A bobbin thread guiding apparatus in combination with a sewing machine comprising a work supporting bed; a throat plate fixed on the work supporting bed and having an opening; a shuttle race slide attached on the throat plate and slidable between a closed position and an opened position; and a horizontally rotating shuttle comprising a bobbin case for containing rotatably a bobbin having bobbin thread, a bobbin thread tension adjusting spring mechanism provided on the bobbin case and for exerting a tension on the bobbin thread drawn out from the bobbin, and a rotating looptaker for containing the bobbin case and the bobbin thread tension adjusting spring mechanism;

said bobbin thread guiding apparatus comprising:

bobbin thread holding means disposed between the shuttle race slide and the horizontally rotating shuttle, and comprising a bobbin thread catching portion for clamping an end of the bobbin thread, and connected with a rear end portion of the shuttle race slide so as to be driven forward and backward by the shuttle race slide;

bobbin thread engagement guiding means for guiding the bobbin thread holding means so that, when the shuttle race slide is driven from the opened position to the closed position, the bobbin thread catching portion moves from a predetermined upper front near position relative to the bobbin thread tension adjusting spring mechanism in a direction along the bobbin thread tension adjusting spring mechanism and then moves to a predetermined position outward of an outer circumference of the bobbin case.

2. A bobbin thread guiding apparatus according to claim 1, wherein the bobbin thread engagement guiding means comprises:

a bobbin case presser plate disposed between the throat plate and the horizontally rotating shuttle, and fixed to the throat plate, and comprising a bobbin passage opening, a first cam groove formed at a left end portion of the bobbin case presser plate, a second cam groove opened along a portion of the bobbin case presser plate corresponding to a left end portion of the shuttle race slide, a first pin engaged movably with the first cam groove, a second pin penetrating movably through the second cam groove, and fixed to the bobbin thread holding means at its upper end, and a link member fixed to the first and second pins at left and right ends thereof respectively, and for determining a swaying position of the bobbin thread holding means through the first cam groove and the first pin when the bobbin thread holding means moves forward and backward.

3. A bobbin thread guiding apparatus according to claim 2, wherein the bobbin thread holding means comprises a holding member, a holding plate spring disposed on the holding member and a vertical drive pin fixed to the holding member at a lower end thereof, and the bobbin thread holding means is connected operatively with the shuttle race slide by means of engaging the drive pin with a drive cam groove formed on the rear portion of the shuttle race slide.

4. A bobbin thread guiding apparatus according to claim 3, wherein the holding member comprises a V-shaped notch and a short slit extending leftward from the V-shaped notch, and the bobbin thread catching portion is constituted with a portion of the holding member and a portion of the holding plate spring.

5. A bobbin thread guiding apparatus according to claim 2, wherein the bobbin case presser plate is provided with guide means for guiding slidably the shuttle race slide forward and backward.

6. A bobbin thread guiding apparatus according to claim 4 further comprising: knife member disposed between the holding plate spring and the shuttle race slide, the knife member being fixed to an approximately rear end of the shuttle race slide and including a cutting edge intersecting with a sharp edge of the shuttle race slide at an acute angle.

7. A bobbin thread guiding apparatus according to claim 4, wherein the holding plate spring comprises a clamp release pin fixed thereto, and the bobbin case presser plate comprises a first island for pushing upward the clamp release pin when the shuttle race slide is at its opened position and a second island for pushing upward the clamp release pin when the shuttle race slide is at its shut position.

8. A bobbin thread guiding apparatus according to claim 7, wherein the bobbin case presser plate comprises a sponge member pressed against the holding member at a position corresponding to the bobbin thread catching portion when the shuttle race slide is at its shut position.

* * * * *